United States Patent [19]

Reil

[11] Patent Number: 4,848,601

[45] Date of Patent: Jul. 18, 1989

[54] PACKAGING MEANS FOR FILLING MATERIALS WHICH ARE CAPABLE OF FLOW, HAVING A PLASTICS COVER

[75] Inventor: Wilhelm Reil, Bensheim, Fed. Rep. of Germany

[73] Assignee: Tetra Pak Developpement S.A., Pully, Switzerland

[21] Appl. No.: 432,830

[22] Filed: Oct. 5, 1982

[30] Foreign Application Priority Data

Oct. 7, 1981 [DE] Fed. Rep. of Germany ..... 3139780

[51] Int. Cl.[4] ..... B65D 47/00

[52] U.S. Cl. ..... 222/528; 222/541; 229/915; 229/4.5

[58] Field of Search ..... 222/556, 541, 542, 562, 222/153, 539, 538, 527, 530, 526, 529; 229/7 R, 17 R, 21, 93, 4.5, 37 R

[56] References Cited

U.S. PATENT DOCUMENTS

| | | | |
|---|---|---|---|
| 2,232,088 | 2/1941 | Waters | 229/21 |
| 2,746,651 | 5/1956 | Lewis | 222/213 |
| 2,961,132 | 11/1960 | Ankney | 222/541 |
| 3,093,273 | 6/1963 | Borah | 222/530 |
| 3,278,089 | 10/1966 | Heekin et al. | 222/541 |
| 3,298,577 | 1/1967 | Chlystun | 222/530 |
| 3,326,421 | 6/1967 | Peace | 222/529 |
| 3,378,177 | 4/1968 | Gran | 222/538 |
| 3,559,847 | 2/1971 | Goodrich | 222/529 |
| 3,750,932 | 8/1973 | Ellison | 229/37 R |
| 3,998,354 | 12/1976 | Song | 222/541 |
| 4,010,875 | 3/1977 | Bafiol | 222/517 |
| 4,011,961 | 3/1977 | Widen, et al. | 215/232 |
| 4,059,201 | 11/1977 | Foster | 222/541 |
| 4,074,961 | 2/1978 | Reil | 425/112 |
| 4,185,747 | 1/1980 | Goncalves | 215/253 |
| 4,185,765 | 1/1980 | McLaren | 229/17 R |
| 4,261,503 | 4/1981 | Lawrence et al. | 229/37 R |
| 4,270,677 | 6/1981 | Schmidt | 222/541 |
| 4,344,545 | 8/1982 | Aschberger et al. | 222/541 |

FOREIGN PATENT DOCUMENTS

| | | | |
|---|---|---|---|
| 605,882 | 11/1934 | W. Germany | X |
| 1,107,745 | 1/1956 | France | X |
| 1,820,263 | 10/1960 | Germ-Util. Mod. | X |
| 1,366,792 | 6/1964 | France | X |
| 1,929,912 | 12/1965 | German-Util. Mod. | X |
| 1,020,798 | 2/1966 | Britain . | |
| 426,529 | 12/1966 | Swiss | X |
| 1486350 | 3/1969 | Fed. Rep. of Germany | 222/529 |
| 1,536,092 | 3/1970 | W. Germany | X |
| 7,017,905 | 10/1970 | German-Util. Mod. | X |
| 7,316,159 | 6/1973 | German-Util. Mod. | X |
| 2,159,035 | 6/1973 | W. Germany | X |
| 2415419 | 10/1974 | Fed. Rep. of Germany | 222/530 |
| 1451926 | 10/1976 | United Kingdom | 229/93 |
| 7,617,656 | 11/1976 | German-Util. Mod. | X |

*Primary Examiner*—Joseph J. Rolla
*Assistant Examiner*—Kenneth Noland
*Attorney, Agent, or Firm*—Howard M. Ellis; Michael L. Dunn

[57] ABSTRACT

A packaging for filling materials which are capable of flow comprises side walls (1) of coated cardboard or the like, which are joined together in a tubular configuration by way of at least one longitudinal sealing seam (4), and end walls which are disposed at the ends of the tube member (1), wherein one end wall which forms the cover (2) of the packaging comprises thermoplastic material without a carrier material, is injected to the side walls (1) along its outer edge (6) and has a pouring spout (13) which can be folded inwardly of the outside contour of the packaging for example for transportation, while the other end wall which forms the bottom is quadrangular and has a transverse sealing seam with triangular flaps which are folded over onto an adjacent wall portion. In order to improve such a packaging, with the aim of providing a properly sealed package, while being easy to open, and also providing the possibility of improved and versatile usability, in particular as an aseptic drinking bottle for infants, the invention provides that the cover has a cover wall portion (20) which converges in a tapered configuration towards the center and which leaves a central opening, with a spout or mouthpiece rim portion (14) having a closure member (13) fastened thereto, wherein the cover wall portion (20) is preferably of a frustoconical configuration and the spout rim portion (14) is of a frustoconical or cylindrical configuration.

6 Claims, 9 Drawing Sheets

Figure 1:
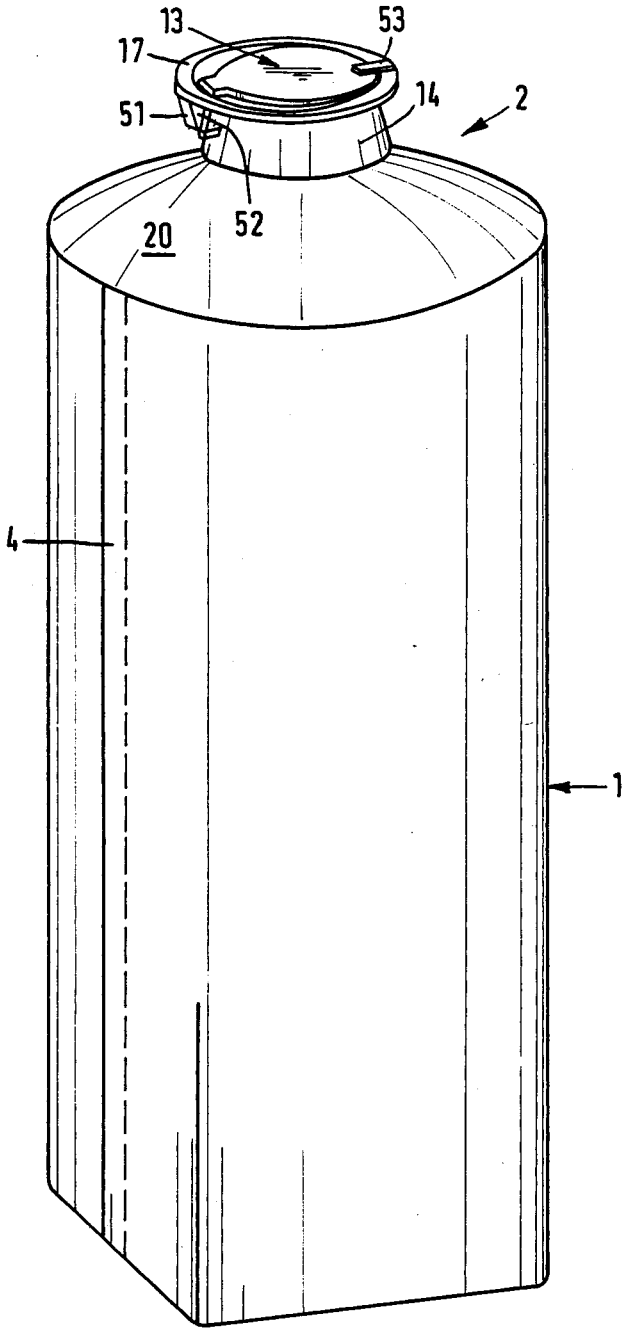

PACKAGING MEANS FOR FILLING MATERIALS WHICH ARE CAPABLE OF FLOW, HAVING A PLASTICS COVER

The invention relates to a packaging means for filling materials which are capable of flow, comprising side walls of coated cardboard or the like, which are joined together in a tubular configuration by means of at least one longitudinal sealing seam, and end walls which are disposed at the ends of the tubular configuration, wherein one end wall which forms the cover of the packaging means comprises thermoplastic material without a carrier material, is joined to the side walls by injection along the outer edge thereof, and has a pouring means which can be folded inwardly of the outside contour of the packaging means for example for transportation, while the other end wall which represents the bottom of the packaging means is quadrangular and has a transverse sealing seam with triangular flaps which are folded over onto an adjacent wall portion.

That type of packaging means which at the present time is most widely used for transporting fluids, in particular milk and fruit juices, is a parallelepipedic packaging means or carton comprising a tube member formed by a carrier material which is coated on both sides with plastics and which is closed at its ends in the region of its end walls by transverse closure ribs, being made into a parallelepiped form, so that there are two oppositely disposed, double-thickness triangular flaps at each end wall. The triangular flaps initially project outwardly from the end walls of the packaging means and are finally folded over against adjacent side wall portions or the end walls of the packaging means.

Suggestions are repeatedly made in an effort to improve pouring openings, more particularly in the carrier material of paper, cardboard or the like, which is coated on both sides with the thermoplastic material, with perforation lines or other weakening lines, in regard to packaging means with covers only comprising plastics material without a carrier material, with fold-type closure arrangements, stoppers or plugs which can be torn off, or the like.

The manufacturers of means for packaging substances which are capable of flow, of the kind set forth above, endeavour to make optimum savings in regard to the consumption of plastics material, and seek to provide simple manufacturing and filling machinery, to achieve good sealing properties for the packaging means, and to make it easy to open such packaging means. In the case of the present invention, the design and use for the manufacture of the means for packaging materials capable of flow, satisfactory sealing and ease of opening are directed to a pouring means which is disposed in the cover and which, like the cover wall portion, entirely comprises thermoplastic material without a carrier.

It is known to provide widely varying pouring means, and it has also already been proposed, in regard to packaging means for materials which are capable of flow, for the cover with pouring means to be injected in such a configuration as the user or consumer subsequently employs the packaging means for pouring out the contents therein. Therefore, in the injection process and also up till the next step in operation during manufacture, the cover is in its configuration of use, that is to say, that configuration in which the final consumer opens the packaging means, pours or shakes out material therefrom, and then possibly re-closes the packaging means. In this connection, there is the advantage that the thermoplastic material, by virtue of its inherent tendency, seeks to return to its original form in which it was injected in manufacture, after it has been deformed. In that case for example a housewife can move the cover from the position of transportation, in which the pouring means was folded inwardly of the outside contour of the packaging means, back into the configuration in which it was injected in the course of manufacture, by pulling and pushing, without requiring an excessive amount of force. If the cover of the packaging means is injected in its configuration of use, then simple injection tools can also be employed.

In comparison with the known and proposed packaging means, the problem of the present invention is to provide an even further improved packaging means with a particularly desirable pouring means which permits easy opening thereof, which prevents liquid from overflowing or being displaced out of the packaging means after it has been opened, and which is suitable for other practical uses, such as for example aseptic filling and aseptic closure for use with liquid baby food.

According to the invention, this problem is solved in that the cover has a cover wall portion which converges in a tapered configuration outwardly and upwardly and which leaves a central opening, with a centrally disposed, upwardly projecting spout or mouthpiece rim portion with a closure member secured thereto. While advantageously permitting particularly simple production tools to be employed, the configuration of the cover in accordance with the invention provides for easy opening thereof, in that the cover which is folded out from the transport position into the position of use causes an increase in the volume of the packaging means so that, when the closure member is opened, the liquid does not splash or slop out of the packaging means at the first moment of opening.

In principle, the cover wall portion may have the pouring opening at the edge thereof, that is to say, at an eccentric position, but in conventional mechanical engineering, the tools used are generally of a symmetrical configuration so that disposing the opening in the centre of the cover wall portion is particularly desirable. The cover wall portion may be of any desired geometrical configuration because injection moulds of varying designs may be used. For example, the cover wall portion may be round or polygonal at its outside edge, so that its geometrical shape may also be similar to a pyramid or a box. It is particularly desirable however for the cover to be round and for the taperedly converging cover wall portion to comprise a frustoconical annular surface with a frustoconical or cylindrical edge or rim portion as the spout edge or rim. The tools and in particular the injection mould are best designed for such a cover. When the cover is of a frustoconical configuration, any milk or fruit juice which unintentionally escapes from the packaging means also runs off outwardly so that the cover region remains generally clean.

In a further aspect of the invention, the outer periphery of the frustoconical annular surface is provided with a further flange portion of cylindrical shape, which is displaced inwardly from the outer edge. The cylindrical flange portion receives the adjacent free end of the tubular member, for which it not only provides a good securing surface but also represents a stiffening or reinforcing means so that the packaging means in accordance with the invention thereby enjoys a particularly high degree of stability. Manufacture is also facilitated in that way because surfaces which are clearly defined from the geometrical point of view and which are not excessively small are available for making the connection between the tubular member which comprises plastics-coated cardboard, on the one hand, and the cover which only comprises thermoplastic material, on the other hand.

In accordance with the invention, it is also desirable for the edge of the tubular member at the cover end to be completely covered by the edge of the cover which projects outwardly. It is precisely when packaging liquids that the manufacturer seeks to cover over cut edges which, because of the cutting action, are no longer covered by plastics material, by forming folded configurations or other overlapping wall portions, so that the liquid cannot penetrate into the carrier or basic material and cause it to become soft. If now use is made of the inward displacement of the flange portion of cylindrical configuration at the periphery of the cover, thereby to form a step, as is provided in accordance with the invention, then the size of the step may be precisely such as to receive the end of the tubular member in a flush condition. In this way, the free edge of the tubular member at the cover end, which is unprotected before the tubular member is joined to the cover, can be covered over by being sealed off.

The invention is further characterised in that the frustoconical annular surface is preferably provided on the inward side of the packaging means with at least one circular weakening groove. Because any liquid which unintentionally escapes will stick in the groove, it is preferable for the weakening grooves to be disposed on the side of the cover, which subsequently faces inwardly of the packaging means. When the cover is of a circular configuration, the weakening groove is also circular; when the cover is of a polygonal configuration, the weakening groove may also be of a corresponding form. The aim and purpose of the weakening groove is to weaken the cover wall portion at the appropriate location: for example in the vicinity of the outer edge and in the vicinity of the inwardly disposed flange portion of cylindrical configuration, so that it is easier for the cover with its pouring means to be folded into the position for transportation, after the injection moulding operation, and it is also easier for the final user of the packaging means to fold the cover with pouring means in the opposite direction into its position of use, and at the same time back into its position as moulded. It is therefore also desirable to provide two concentric weakening grooves on the inside and the outside.

In accordance with the invention, it is also advantageous for the spout or mouthpiece rim portion to have an upwardly raised dome with a closure means for closing off the central opening, wherein the closure member preferably has a weakened extension portion on the wall portion of the dome, with a gripping portion thereon. A packaging means provided with such a pouring means may be in the form of a drinking bottle for a baby, because the shape of the dome can be satisfactorily adapted to the shape of a sucking teat or dummy. In the last-described embodiment, the uppermost part of the dome configuration, which is therefore at the greatest distance from the bottom of the packaging means when the cover is in its outwardly extended condition in a position of use, has a weakened location which communicates with the adjacent wall portion of the dome and a gripping portion which is injection-moulded thereon. The gripping portion is in the form of a ring, arm, plate or the like and permits the arrangement to be easily gripped and lifted up, thereby forming the pouring hole at the weakened location. The hole may be as fine as that which is provided in a teat or dummy, so that the packaging means can be used as a baby's drinking bottle.

The configuration of the packaging means with the cover in accordance with the invention is highly desirable when the bottom of the packaging means is in the form of the per se known block bottom with a transverse sealing seam and triangular flaps. It is known that such an end wall arrangement may be converted from its quadrangular configuration into the form of the end of a tubular member, by lifting up the triangular flaps which are attached to the adjacent side wall portion, and then compressing the end of the packing means.

If the packaging means with the cover in accordance with the invention has such a bottom arrangement, then the baby can empty the contents of the packaging means by sucking thereon, even when air is not introduced into the packaging means from the outside, in order to compensate for the liquid which is to be taken from the packaging means. The compensating effect is produced in practice by compressing the packaging means, just as toothpaste is taken from a tube by pressing on the end of the tube. In this respect, the packaging means with the cover in accordance with the invention is superior to a glass drinking bottle for babies.

Such a packaging means opens new areas of use, if for example we think of the provision of liquid baby food in quite general terms and in particular in third world countries.

In addition, it is particularly advantageous if, in accordance with the invention, the annular surface with the dome is folded inwardly of the outside contour of the packaging means, with a cover plate or sheet member being secured in a flat condition on the outside edge of the cover, possibly providing an aseptic seal. Not only materials to aid and relieve areas in a state of emergency and distress but generally baby food in liquid form can be supplied in an aseptic condition by means of such a pouring arrangement. For example, the cover wall portion can be satisfactorily sterilised by suitable means, such as electron beam irradiation, in the course of mass production, and the sterile condition can be satisfactorily maintained even over a prolonged period of time, by virtue of the cover sheet or plate member. It will be seen that it is very easy to tear off a cover sheet or plate member in order to use the material in the packaging means, and that permits small children to be fed under extremely hygienic conditions.

Figure 2:
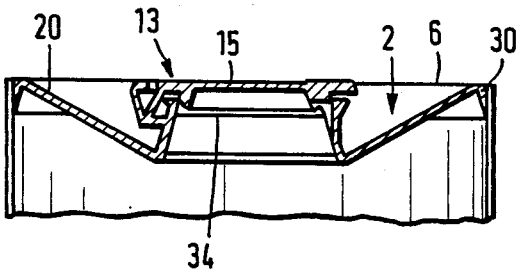
Figure 3:
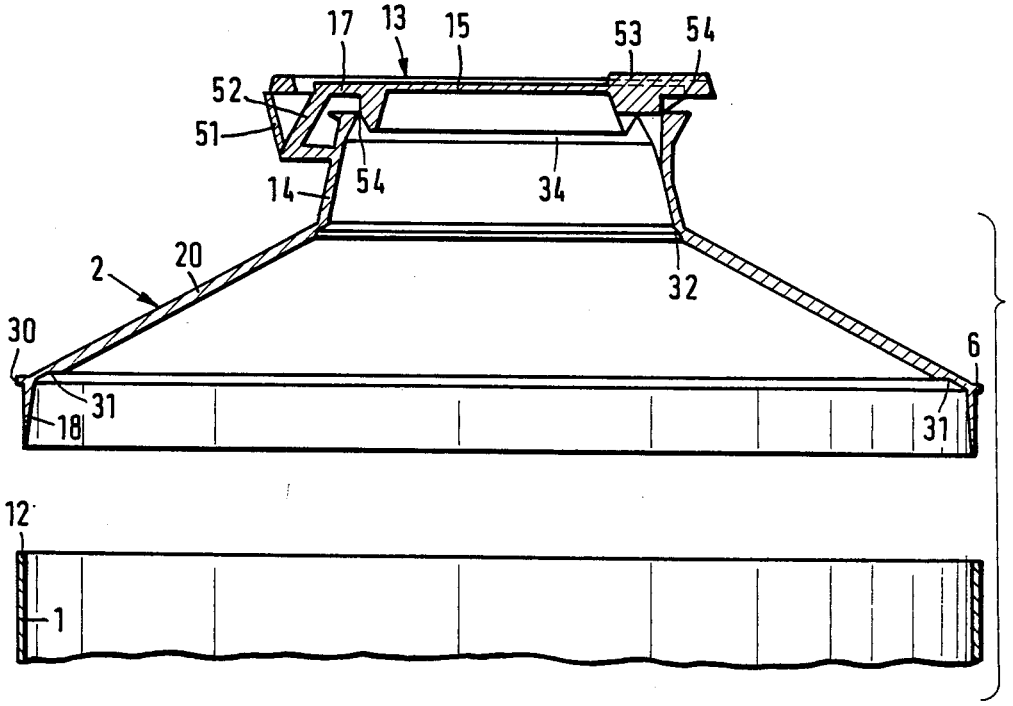
Figure 4:
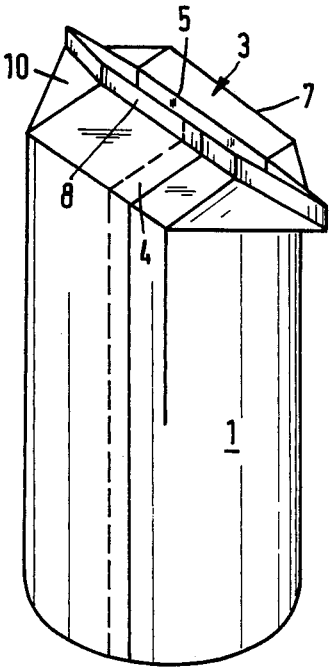
Figure 5:
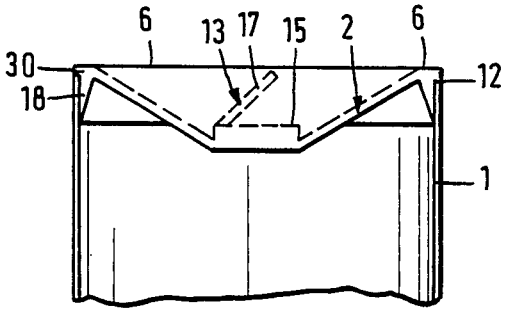
Figure 6:
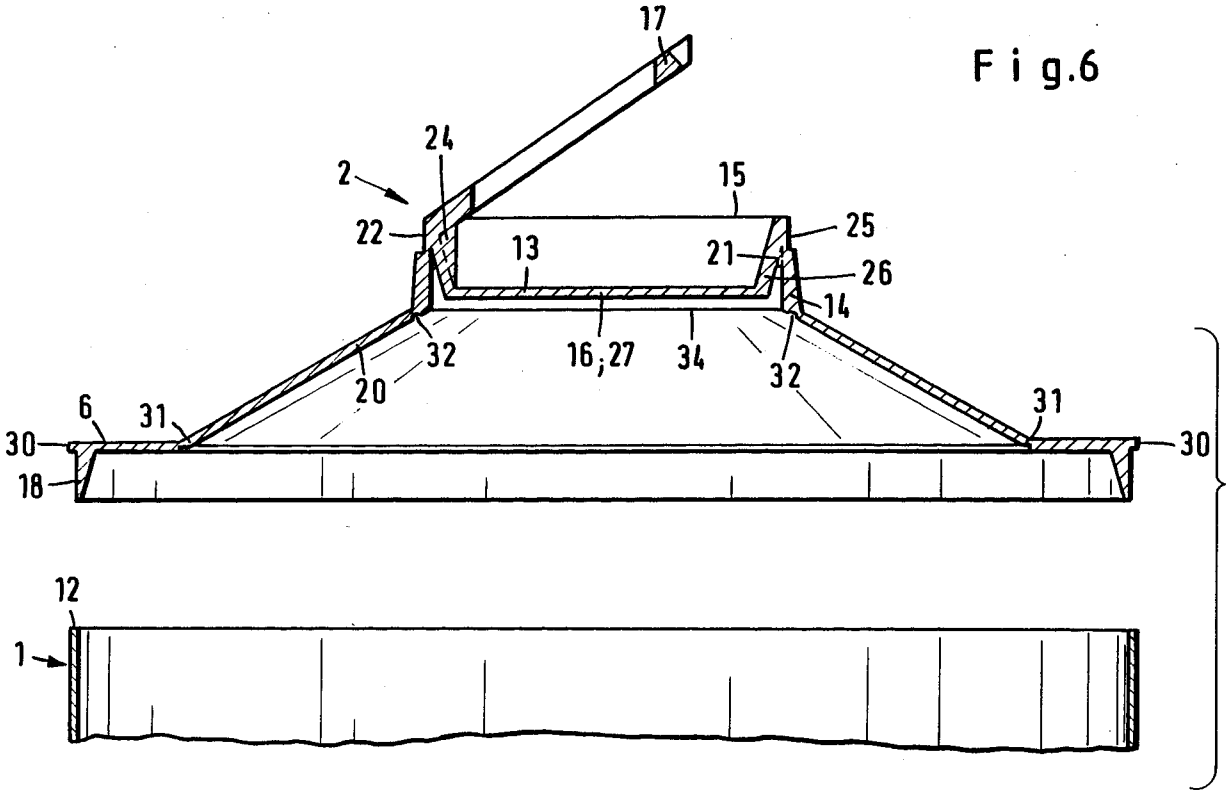
Figure 7:
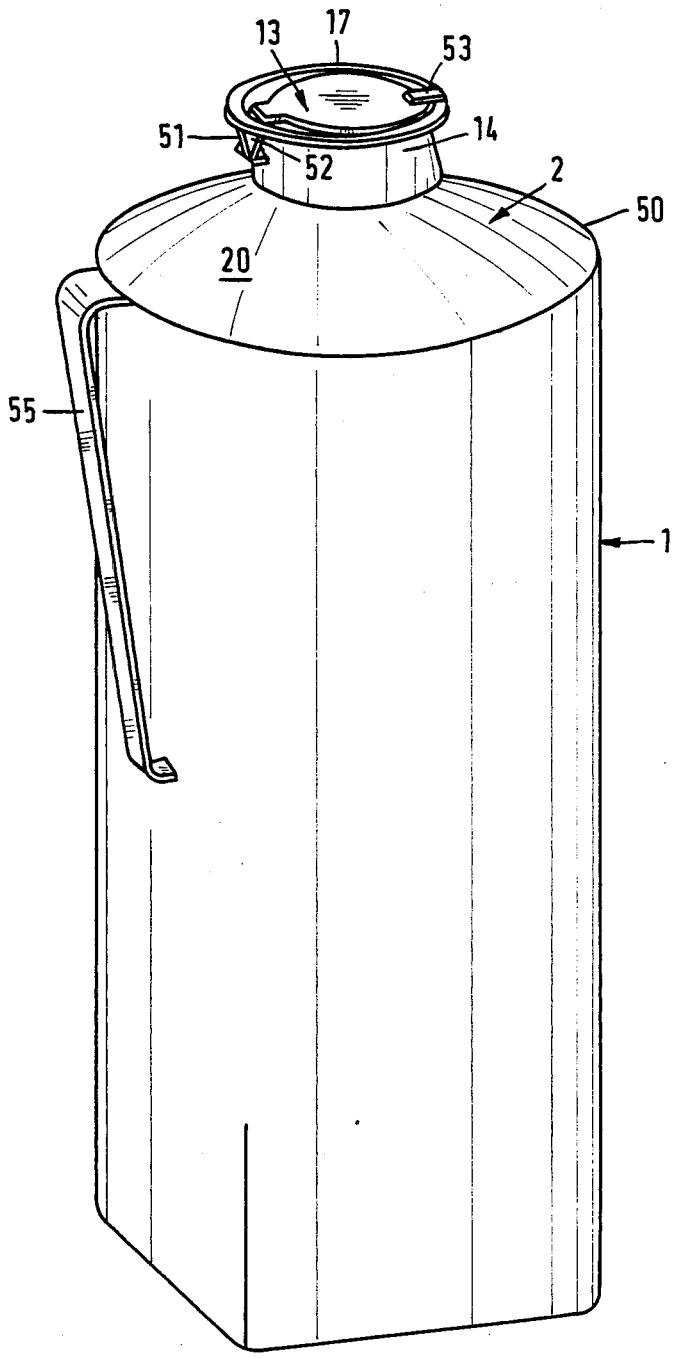
Figure 8:
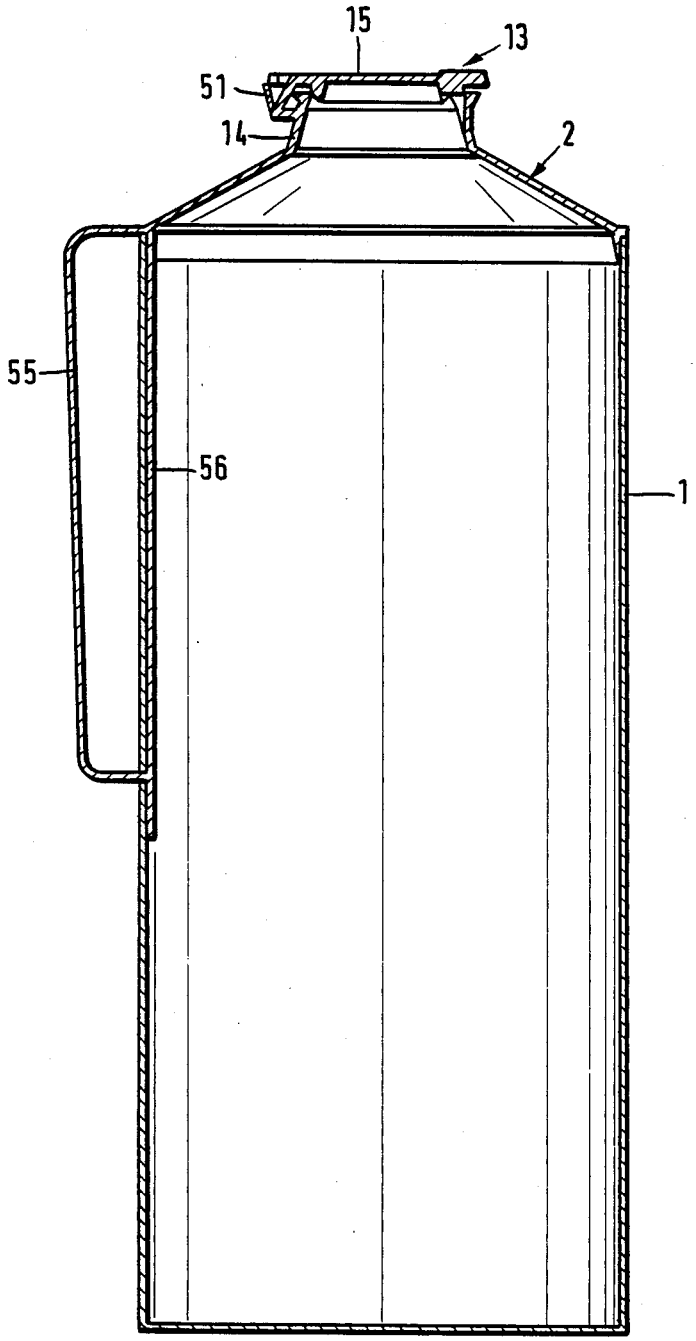
Figure 9:
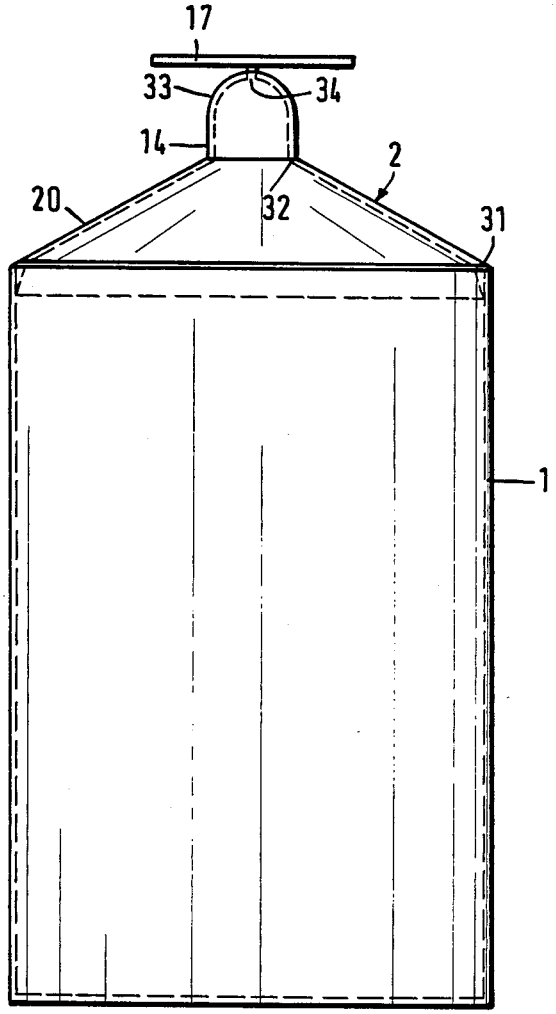
Figure 10:
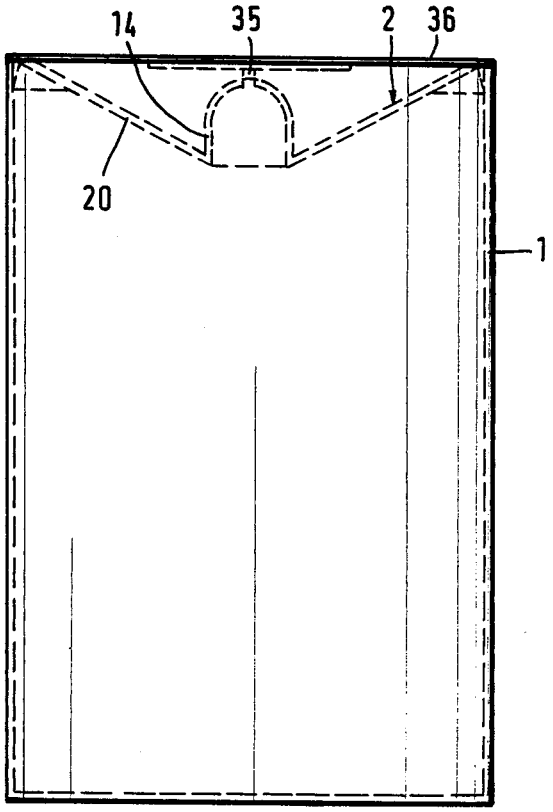
Figure 11:
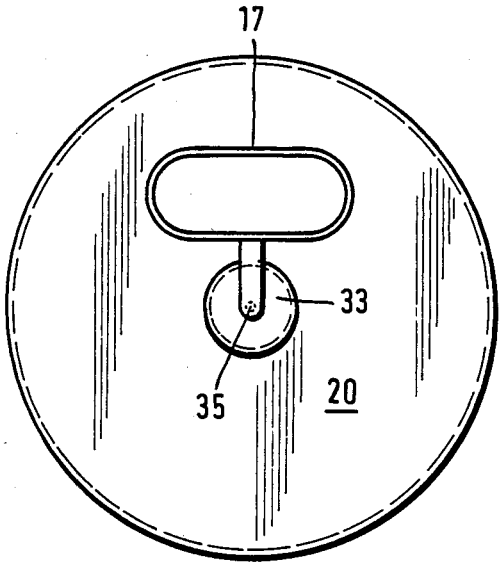

Further advantages, features and possible uses of the present invention will be apparent from the following description of preferred embodiments, in conjunction with the drawings in which:

FIG. 1 shows a perspective view of a first preferred embodiment of the closed packaging means in a condition of being ready for use, FIG. 2 shows a broken-away sectional view of the end wall at the cover end of the embodiment shown in FIG. 1, in its configuration for transportation, wherein no portions of the arrangement project beyond the overall outside contour of the packaging means, FIG. 3 shows the same embodiment as that shown in FIG. 2 but wherein the cover is arranged separately from the end of the tube member which is shown in broken-away form, with the cover being shown in the condition of use by the final consumer, with the pouring opening projecting upwardly, FIG. 4 shows a perspective view of the bottom end of the packaging means shown in FIG. 1, before the transverse sealing seam is formed but after the bottom has been folded into the block bottom configuration, FIG. 5 shows a sectional view of a composite packaging means having a cover in accordance with a second embodiment of the invention, wherein once again portions of the arrangement do not project beyond the overall contour of the packaging means, FIG. 6 shows a view similar to that of FIG. 3, but showing the other second embodiment of the pouring opening shown in FIG. 5, FIG. 7 is a perspective view of a third preferred embodiment of the packaging means in a closed condition in which it is ready for use, with a handle, FIG. 8 shows a sectional view of the packaging means shown in FIG. 7 with the pouring spout or mouthpiece in the same closed condition, but projecting upwardly beyond the outside contour of the packaging means, as in FIG. 7, FIG. 9 shows a sectional view of a combined packaging means having a cover, in accordance with a fourth embodiment of the invention, with an upwardly projecting dome as the pouring opening, FIG. 10 shows the same kind of view and embodiment as in FIG. 9, but with the cover being folded inwardly into the condition for transportation, and with a cover sheet or plate member in position on the packaging means, and FIG. 11 shows a plan view of the cover of FIG. 9, with an annular gripping portion fitted thereto.

The finished packaging means for filling materials which are capable of flow, in which respect milk may be preferably referred to by way of example, as shown in FIG. 1, comprises side walls which are generally indicated by reference numeral 1, because, in this specific embodiment which also recures in the other Figures of drawings, the packaging means is of round cross-section in the region of the cover 2. Because the tubular side walls 1 are of circular cross-section in the region of the cover 2, a distinction can possibly be made between the four sides, at the end wall which forms the bottom 3 of the packaging means.

The side walls 1 are made into the shape of a tubular member and joined along the longitudinal sealing seam 4 which for the sake of simplicity is no longer shown in FIGS. 7 to 10, in order definitively to form the closed tube. It will be seen from FIG. 4 that the longitudinal seam 4 extends into the bottom 3. While the end of the tube is indicated by reference numeral 5 (at the edge), the outer edge 6 of the cover will be seen, on the opposite side; the outer edge 6 forms what might be called the upper edge or upper surface of the overall contour of the container, when the cover is in its form for transportation (see FIGS. 2 and 5).

The upper edge or surface of the packaging means when in the finished condition is formed, at the bottom end 3, by the line indicated at 7 in FIG. 4, which also shows the double-layer cardboard strip 8 when the bottom is of a block bottom configuration. FIG. 4 also shows the triangular flaps 10 which, in the position shown in FIG. 4, initially still project out on both sides of the bottom 3, in the same plane, and are subsequently folded over onto (any) adjacent side surface, where they are secured in position as by adhesive.

Before the operation of forming the block bottom, the cover 2 is liquid-tightly injected onto the edge 12 (FIGS. 3 and 6) at the cover end of the tubular member or side walls 1. In contrast to the quadrangular bottom 3, in the novel packaging means, the cover 2 which is preferably but not necessarily of a round or circular configuration, is only made of thermoplastic material, without a carrier or base material therefor. The cover 2 is laid onto the edge 12 at the cover end of the tubular member 1, where it is sealed in position, in the manner which is shown particularly clearly in FIGS. 2 and 5. In that sealing or injection operation, when the cover is therefore injected onto the edge 12 of the tubular member 1, while covering over the cut edge 12, the cover 2 is in a configuration corresponding to the configuration of use, as shown in FIGS. 3, 6 and 7 to 9.

In contrast, FIGS. 2, 5 and 10 show the configuration for transportation, in which the pouring means generally indicated by reference numeral 13 is folded inwardly of the outside contour of the packaging means in such a way that no individual parts of the pouring means 13 project beyond the outside edge 6 of the cover 2. This ensures that the packaging means enjoys satisfactory stability and can be readily enclosed by packaging material (by means of shrink films or the like).

In the first embodiment shown in FIGS. 1 to 4, the pouring means 13 is disposed centrally on the cover 2 in the form of an outwardly and upwardly projecting spout or mouthpiece edge or rim portion 14 which is of a slightly frustoconical configuration and which therefore, as viewed broadly, can also be approximately cylindrical. The upper edge 15 forms the closure means, while in the embodiment shown in FIGS. 5 and 6, the upper edge 15 is connected to a closure plug member 16. All embodiments have a gripping ring 17 welded thereto.

The precise shape after the injection production operation of the cover 2 in the first embodiment shown in FIGS. 1 to 3 is particularly clearly visible from FIG. 3. The outside rim or edge 6 of the cover 2 is virtually only a narrow ring, while displaced inwardly from the outer edge 30 thereof is a further flange portion 18 of cylindrical configuration, forming so-to-speak a support portion, such that the edge 12 of the tubular member 1, at the cover end thereof, is completely covered by the outwardly projecting outer edge 30 of the cover 2.

The foregoing description also applies to the lastmentioned construction for covering over the edge 12 of the tubular member, in the embodiment shown in FIGS. 5 and 6, except that the outer edge 6 of the cover 2 is a wider ring. In all the illustrated embodiments, the upper end of the tubular member 1 with its edge 12, and thus the upper edge of the side wall 1, come to lie around the flange portion 18 which acts as a supporting arrangement. This provides a particularly strong and stiff connection between the cover 2 and the side wall 1.

It will also be seen that in all the illustrated embodiments of the cover 2, the cover 2 has a cover wall portion 20 which converges in a tapered configuration towards the centre and which is specifically a frustoconical annular surface. It converges outwardly and upwardly, in the form of the frustoconical annular surface. In the transportation configuration as shown in FIGS. 2, 5 and 10, the frustoconical portion projects inwardly approximately at the same angle.

FIGS. 1 to 3, 7 and 8 show that the ring 17 is attached by way of a thin holding strip 51 to the wider hinge 52 which is in the form of a strip portion and which in turn is formed on the frustoconical spout rim portion 14. At the side remote from the mounting strip 51, the ring 17 is fixedly mounted to the closure member 13 by way of a bar portion 53. The closure member 13 is in turn disposed on the rim portion 14 at the top thereof, by way of an annular weakening line 54, as can be clearly seen from FIG. 3. FIG. 3 also shows that the bar portion 53 projects radially outwardly beyond the upper edge of the rim portion 14, in order thereby to make it easy to grip. At the side opposite to the bar portion 53, the closure member 13 is in turn secured to the rim portion 14 by way of the hinge 52. The hinge 52 forms a strong connection between the rim portion 14 and the closure member 13, but is nonetheless elastic and permits the closure member 13 to be pivoted upwardly so that the edge 15 thereof can be moved from the horizontal position, being the condition shown in FIG. 3, into a tilted and possibly even vertical position. It will be appreciated in this respect that this arrangement provides for easy re-closability.

In the embodiment shown in FIGS. 5 and 6, reference numeral 21 denotes a location at the top on the edge 15 of the rim portion 14 which in this case is of a cylindrical configuration. The portion 21 is of comparatively large thickness, while the arrangement also has an annular weakening line 22, similarly to the line 54 in the embodiment shown in FIGS. 1 to 3. The weakening lines 22 and 54 extend around the spout rim portion 14 over almost 360°, as a weakened location; or, as shown in FIG. 6, around the closure plug-like member 16 so that the member 16 can be easily torn out, to open the packaging means. A connecting means (not shown in greater detail) for connecting the gripping ring 17 projects beside the location on the weakening line which is indicated at 22 in FIG. 6, and disposed beside the gripping ring connecting location is a curvature portion 24 which projects inwardly towards the centre from the rim portion 14, in such a way that the wall of the portion 24 extends inwardly as shown in FIG. 6 and is only separated from the surrounding environment by the weakening line 22. When the user tears open the weakening line 22, by tearing on the gripping ring 17 (in an upward direction in FIG. 6), then the weakening line 22 breaks open first in the region of the portion 24 so that air can advantageously pass into the space under the cover 2, after the upward movement of the cover into the position shown in FIG. 6 resulted in an increase in the volume of the packaging means.

The embodiment shown in FIGS. 1 to 3 does not have the above-discussed particular curved portion. In that case it is sufficient for the user to tear apart the mounting strip 51, pull the bar portion or ring 17 upwardly, and use the bar portion 53 to tear the closure member open along the weakening line 54, over a complete peripheral range of 360°. Continuing to pull the gripping portion 17 upwardly then causes the closure member 13 or the edge 15 to move into the above-discussed inclined position, so that the opening 34 is more or less completely exposed, for the purposes of pouring material out of the packaging means.

In the embodiment shown in FIGS. 5 and 6, disposed diametrically opposite the portion 24 as shown in FIG. 6, on the right-hand side of the closure plug member 16, in the vicinity of the location 21, is the hinge 25 for the closure plug member 16. The latter may accordingly be moved about the hinge 25 in the clockwise direction, that is to say, turned in the direction for opening thereof, without the closure plug member 16 being immediately torm off. By virtue of this arrangement, the embodiment shown in FIGS. 5 and 6 also affords the possibility of being re-closable, especially as the closure plug member 16 has an edge or rim portion 26 which extends approximately towards the spout rim portion 14 and which is only closed off by the flat bottom portion 27.

It will be seen in regard to the embodiments shown in FIGS. 1 to 8 that the frustoconical annular surface 20 is provided, on the side of the cover 2 which is subsequently directed inwardly of the packaging means, with two circular weakening grooves 31 and 32 which are arranged concentrically relative to each other. The grooves 31 and 32 are expressly designated in FIGS. 3 and 6.

The embodiment shown in FIGS. 7 and 8 differs from that shown in FIGS. 1 to 4 only by virtue of the handle 55 which is mounted by way of a reinforcing strip 56 applied to the packaging means, to the side of the packaging means which is opposite to the bar portion 53, that is to say, on the same side as the hinge 52, at the upper end of the side walls 1. The upper end of the handle 55 is desirably disposed in the vicinity of the edges 12 and 30. The spout rim portion 14 with the closure member 13 is otherwise of the same design as was described in greater detail hereinbefore with reference to FIG. 3.

FIGS. 9 to 11 show the fourth embodiment of the cover 2, wherein the pouring means has an outwardly upwardly projecting dome 33 with a closure member 35 for sealingly closing a central opening 34 in the top of the dome. The closure member 35 represents the wall of the dome 33, with a punctiform weakened location for forming the opening 34, wherein the handle or gripping member 17 which is of an oval configuration as shown in FIG. 11 is injected at the same time on the closure member 35.

Directly after the injection operation, the cover 2 is of the configuration shown in FIGS. 9 and 11, in which the annular cover wall portion 20 projects outwardly and upwardly.

While the closure member 13 in the other embodiments is only folded inwardly of the outside contour of the packaging means for transportation, without further steps being taken, the broken lines in the view shown in FIG. 10 show the cover in the inwardly folded condition, with a cover plate or sheet member 36 as shown in solid lines, which is secured evenly to the outside edge 6 of the cover 2. Therefore, for the purposes of opening the package, the cover plate or sheet member 36 which is possibly secured in position by a sealing action so as to form an aseptic seal must first be destroyed, and the cover 2 can then be moved into its position of use, by gripping the ring 17; when the consumer then continues to pull the gripping ring 17 upwardly until the opening 34 is exposed, the dome member 33 can be immediately put to the mouth of an infant without the user touching the surfaces of the dome member 33 with a hand or contaminating it in some other fashion.

The user produces the tubular configuration at the bottom end of the packaging means by altering the packaging means from the state thereof shown in FIG. 9 or FIG. 10 at the bottom end thereof, in such a way that (see FIG. 4) the triangular flaps 10 are pivoted out into the plane of the bottom 3. The consumer then presses on the corners transversely with respect to the direction of the double cardboard ply 8 so that the quadrangular shape becomes a rectangular shape or substantially even the shape of the lower closure seam which in FIG. 4 is formed by the double-layer cardboard ply 8.

I claim:

1. A packaging means for filling materials which are capable of flow, comprising side walls of coated cardboard or the like joined together in a tubular configuration by means of at least one longitudinal sealing seam, said sidewalls having an outer rim, and end walls disposed at the ends of the tubular configuration, wherein one end wall forms the cover of the packaging means and comprises a thermoplastic material without a carrier material, said cover being joined to the side walls by injection along the outer rim thereof, said cover having a pouring means which can be folded inwardly of the outside contour of the packaging means, while the other end wall representing the bottom of the packaging means is quadrangular and has a transverse sealing seam with triangular flaps folded over onto an adjacent wall portion, the cover having a cover wall portion with a frustoconical annular surface converging in a tapered configuration towards the centre leaving a central opening with a upwardly projecting spout, said spout being equipped with a closure member and a rim portion, said cover including a flange portion of cylindrical configuration disposed at the periphery of the cover and displaced inwardly from the outer edge thereof to form a projecting outer edge for covering the rim of the side walls.

2. A packaging means according to claim 1 characterised in that the cover is round and the spout rim portion has a cylindrical configuration.

3. A packaging means according to claim 2 characterised in that the frustoconical annular surface of the cover includes at least one circular weakening groove on an inner surface thereof.

4. A packaging means according to claim 1 characterised in that the spout rim portion is an outwardly projecting dome for closing off the central opening.

5. A packaging means according to claim 4 characterised in that the closing means comprises a weakened extension of the dome with gripping means disposed thereon.

6. A packaging means for filling materials which are capable of flow, comprising side walls of coated cardboard or the like joined together in a tubular configuration by means of at least one longitudinal sealing seam, and end walls disposed at each end of the tubular configuration wherein one end wall forms the cover of the packaging means and comprises a thermoplastic material without a carrier joined to the side walls by injection along the outer edge thereof, the other end wall forming the bottom of the packaging means and being quadrangular in configuration and including a transverse sealing seam with triangular flaps folded over onto an adjacent wall portion, said cover including a cover wall portion with a frustoconical annular surface converging in a tapered configuration towards the centre to provide a centrally disposed outwardly projecting dome suitable for being folded inwardly of the outside contour of the packaging means, the dome including closure means for closing off a central outlet therein, the packaging means including means for forming an asceptic seal in a flat condition on the outer edge of the cover.

* * * * *